United States Patent [19]

Sadow

[11] Patent Number: 4,763,763

[45] Date of Patent: Aug. 16, 1988

[54] CONVERTIBLE CARRYING HANDLE AND SHOULDER STRAP FOR AN ATTACHE CASE

[75] Inventor: Bernard D. Sadow, Chappaqua, N.Y.

[73] Assignee: B.D.S., Luggage Corporation, New York, N.Y.

[21] Appl. No.: 118,728

[22] Filed: Nov. 9, 1987

Related U.S. Application Data

[63] Continuation of Ser. No. 857,151, Apr. 29, 1986, abandoned.

[51] Int. Cl.[4] ..... A45C 13/76

[52] U.S. Cl. ..... 190/115; 16/125; 150/108; 190/1; 224/151; 294/141; 294/168

[58] Field of Search ..... 190/115, 116, 1; 294/141, 142, 167, 168, 170; 224/151, 202; 16/115, 125; 150/107, 108, 110, 521

[56] References Cited

U.S. PATENT DOCUMENTS

| | | | |
|---|---|---|---|
| 1,047,941 | 12/1912 | Hollingsworth | 190/115 |
| 1,598,719 | 9/1926 | Hiering | 150/108 |
| 1,735,655 | 11/1929 | Pitkin | 150/108 |
| 2,092,141 | 9/1937 | Rowold | 150/108 |
| 2,394,782 | 2/1946 | Kalshe | 294/141 |
| 2,769,475 | 11/1956 | Fisher | 150/108 X |
| 2,960,137 | 11/1960 | Lipsitz | 150/521 |
| 3,161,271 | 12/1964 | O'Neil | 190/115 |
| 4,014,374 | 3/1977 | Douglas, Sr. | 150/110 X |
| 4,489,815 | 12/1984 | Martinez et al. | 190/1 |

FOREIGN PATENT DOCUMENTS

| | | | |
|---|---|---|---|
| 626278 | 7/1949 | United Kingdom | 150/108 |
| 857965 | 1/1961 | United Kingdom | 150/108 |

*Primary Examiner*—Stephen Marcus
*Assistant Examiner*—Bryon Gehman
*Attorney, Agent, or Firm*—Abelman Frayne Rezac & Schwab

[57] ABSTRACT

A convertible carrying handle and shoulder strap for hand luggage has bails fixed to a top wall of a peripheral frame of the luggage and through which straps are slidable, the straps being attached at one of their ends to a handle positioned between the bails and having fastener members at their free ends for attachment to side walls of the peripheral frame.

3 Claims, 2 Drawing Sheets

CONVERTIBLE CARRYING HANDLE AND SHOULDER STRAP FOR AN ATTACHE CASE

This is a continuation of application Ser. No. 857,151 filed on Apr. 29, 1986, now abandoned.

FIELD OF THE INVENTION

This invention relates to hand luggage such as a suitcase, an attache case, a briefcase of the like, of the type including a substantially rigid peripheral frame having a carrying handle connected to an upper surface thereof.

BACKGROUND OF THE INVENTION

Typically, the frame of such a case is incorporated into a tray-like bottom portion of the case, and provides the top, bottom and end walls of the case. The frame is closed by either a rigid sidewall, or, by a side wall formed from a compliant fabric material which is attached to the perpheral edges of the frame at one side thereof. A closure for the tray-like bottom portion is provided either by a tray-like top portion hinged to the bottom portion, or, by a closure wall formed from a compliant fabric material which is connected to the bottom wall of the frame at its opposite side, and can be secured to the remaining walls of the frame at its opposite side by one or more slide fasteners.

A handle for carrying the case is attached to the top wall of the frame and centrally thereof, for example, by rivets, sewing, or swing bails, the handle usually being a leather covered member having an internal stiffener. The present invention relates in particular to a case of this type.

With such cases, the user has only the normal option of graspig the handle and lifting the case by the handle, and, transportig the case with the case hanging at arms length. This option not only requires the use of one of the users hands and immobilization of the associatd arm of the user, but also can constitute a source discomfort to the user, particularly if the case is heavy and it to be carried for long distances.

SUMMARY OF THE INVENTION

According to the present invention, a second option is provided to the user, that being of carrying the case by means of a shoulder strap, thus permitting the case to be suspended from the user's shoulder and freeing both of the user's hands and arms for other uses.

To permit this second option, the conventional handle of the said conventional case is attached at each of its ends to a flexible strap. The staps extend through bails fast with the top wall of the frame, and are freely slideable through the bails in directions axially of the straps.

The free ends of the straps are each provided with enlarged members of dimensions greater than the cross section of the straps and greater than those of the throat of the associated bail, and, each are provided with one member of conventional fastener, such as the socket portion of press stud fastener, for cooperation with a correponding stud member rigidly affixed to its associated side wall of the frame.

The bails are spaced from each other by a distance permitting the interposition therebetween of the handle when the handle is located in its position of normal usage.

In that position, the straps are extended in opposite directions along the top wall of the frame, and are then extended downwardly along the end walls thereof, and, are attached at their ends to the side walls using the fasteners associated therewith.

The fasteners are positioned such that there is little or no slack in the straps, or, the straps are maintained under slight tension.

The handle is thus held substantially immovable relative to the top wall of the frame, and can be used for hand carrying of the case. The straps at that time are placed under tension by virtue of the weight of the case, the axial stress in the straps acting perpendicular to the fasteners in shear relation relative thereto, and being absorbed in the fasteners.

Should the user decide to convert the case from the hand carrying option to the shoulder carrying option, all that is necessary is for the user to free the ends of the straps from their associated fasteners, and then to slide the straps axially through their associated bails until such time as the enlargements on the free ends of the straps engage with the bails and permit the straps again to be tensioned.

Preferably, the handle is formed from a resilient material, or, it is suitably padded in order to provide added comfort to the user when the straps are used as a shoulder strap.

Optionally, the bails can be metal straps secured to the frame in any convenient manner, or, the bails can be formed from a flexible material, such as leather, and sewn or riveted at their ends to the frame.

While press stud fasteners can be used as the fastening members for the straps, many other forms of fastener can be substituted therefor, such as metal toggles, slide bar fasteners, or hinged snaps, any of which may be selected for decorative and aesthetic enhancement of the appearance of the case.

Further, while the ends of the straps must be formed as enlarged members to prevent their withdrawal through the bails, the enlargements can be provided by members attached to the ends of the straps and which are of greater width than the straps. The said members can be the ones for cooperation with the associated toggle, slide bar, or hinged snap, if such is used in lieu of press stud fasteners.

BRIEF DESCRIPTION OF THE DRAWINGS

A preferred embodiment of the invention will now be described with reference to the accompanying drawings in which.

DESCRIPTION OF THE PREFERRED EMBODIMENT

Figure 1:
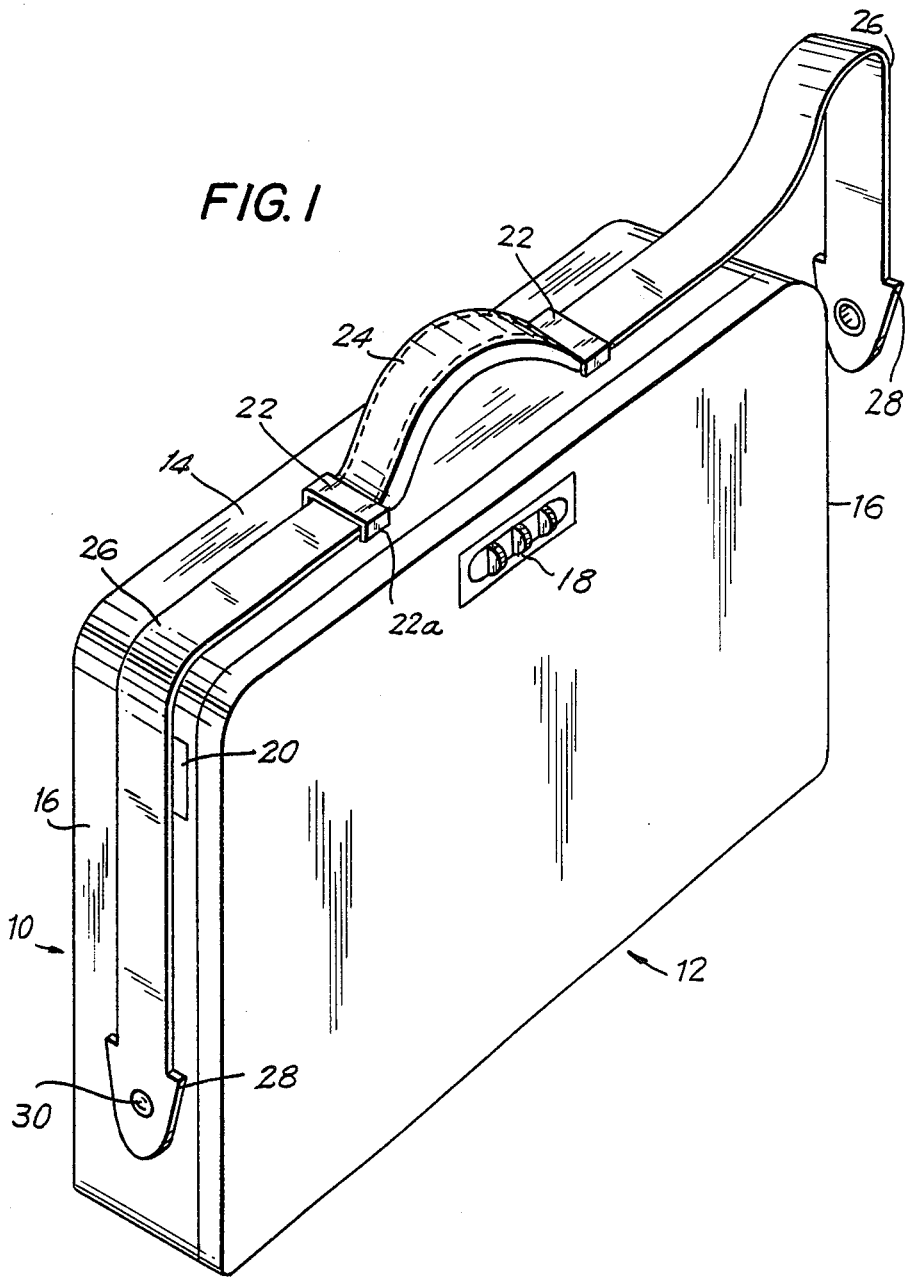
FIG. 1 is a perspective view of a case incorporating the convertible handle and shoulder strap of the present invention when in the normal hand carrying position.

Referring firstly to FIG. 1, there is shown an attache case incorporating the convertible handle and straps of the present invention, the attache case including a bottom tray-like portion indicated generally at 10, to which is hinged a top cover portion indicated generally at 12.

The lower tray-like portion in this particular embodiment is of a rigid construction, and inculdes a rigid peripheral frame having a top wall 14, side walls 16, a bottom wall (not shown).

The cover is provided with a lock 18, which in this instance is illustrated as a combination lock, and also is provided with lid release locks 20, only one of which is visible in FIG. 1.

Secured to the top wall 14 and spaced axially from each other are a pair of U-shaped bails 22. The spacing between the bails is approximately that of the length of a handle 24, which is shown in FIG. 1 as positioned between the bails, and, which is attached at its respective ends to flexible straps 26.

The straps 26 are formed of any suitable flexible material, such as leather or woven nylon, and terminate at the respective ends in enlarged portions 28 of a width in the latteral direction of the straps in excess of the spacing of the arms of the U-shaped bails 22. The respective straps 26, at the free ends, have mounted thereon a socket 30 of a press stud fastener, the other element 32 providing the stud of the fasteners being rigidly affixed to the associated end wall 16 of the peripheral frame.

When the press stud fasteners are interengaged, the straps 26 are retained substantially stretched over the exterior of the top wall and end walls of the frame, such that the handle 24 can be grasped by the user, and, used in an entirely conventional manner as a carrying handle for the attache case.

Figure 2:
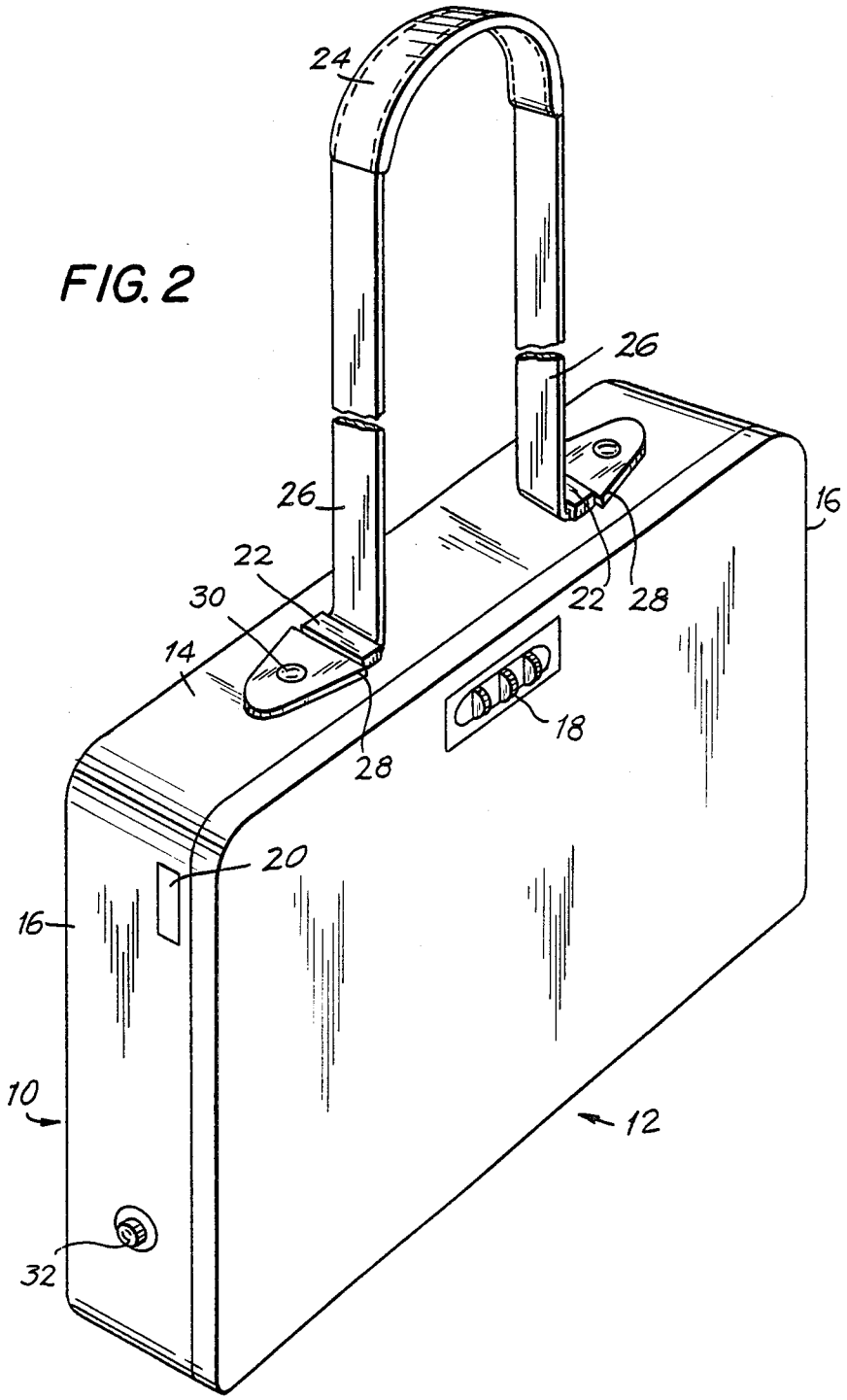
FIG. 2 illustrates the case of FIG. 1 when the convertible handle and shoulder strap is in a shoulder carrying position.

Should the user so desire, and as is illustrated in FIG. 2, the handle 24 almost instantaneously can be converted from its normal usage as illustrated in FIG. 1, into a shoulder strap as illustrated in FIG. 2. All that is required to effect this conversion is to detach the sockets 30 from the studs 32, and then slide the respective straps 26 longitudinally through their associated bails 22 until such time as the enlarged end of the respective straps is in abutment with and retained by the associated bail 22.

As illustrated, the bails 22 are comprised by inverted channel shaped members, which conveniently may be formed from polished brass or the like, and which have downwardly extending legs 22*a* secured in the top wall 14 of the frame in any convenient manner, such as by providing the legs with tangs which extend through slots in the top wall 14 of the frame, and which are then turned for them to lie in the plane of the top wall.

The bails need not be formed of metal. Instead, the bails may formed of strips of leather or similar material which is stitched, riveted, or otherwise secured to the top wall 14 of the frame at the respective ends of the strips.

Alternatively, the bails may be in the form of elongate loops of metal wire that are pivotally secured at one of their long sides to the top wall 14 of the frame in order to provide swing bails for the retention of the straps 26. Further, alteratively, the bails can be proivded by shafts or rollers supported in journal blocks fast with the top wall of the frame.

In all instances, the bails 22 are arranged to provide a throat through which the straps 26 are passed and which has a width and a depth only slightly in excess of the width and thickness of the straps, and, which has a width less than the width of the enlarged portions 28 at the respective ends of the straps.

As well be readily appreciated, in order to restore the handle to its normal carrying position, all that is necessary is for the user to draw the straps 26 through the bails 22, and then to extend the straps downwardly over the end walls of the case, and reattach them to the end walls of the case by means of the press stud fasteners.

As also well be readily appreciated, any other convenient form of fastening members can be employed in replacement of the press stud fasteners 30, provided of course that they are capable of absorbing the lateral shear loading produced by the tensioning of the straps on lifting of the case by the handle when in its normal position. Various toggles, slide bar mechanisms and hinged snaps are well known and commonly available in the art, and can readily be substituted for the illustrated press stud fasteners if so desired.

I claim:

1. In an attache case comprising a bottom tray-like portion hinged to a top cover portion, the bottom tray-like portion having a substantially rigid peripheral frame comprising a top wall, a bottom wall and two side walls, the improvement comprising;

a substantially rigid elongate carrying handle positioned centrally of the top wall of said frame and of lesser length than the length of said top wall having opposite ends;

straps of lesser thickness than the thickness of said handle attached to said handle and providing continuations of said respective opposite ends of said handle and arranged in axial alignment with said handle, said straps respectively terminating in free ends;

means attached to said free end of each of said straps, said means being of a dimension appreciably greater than the cross-section of said respective straps;

bails attached to said top wall of said peripheral frame and through which an associated one of said straps is slidable in longitudinal directions, said bails being spaced by a distance only slightly in excess of the distance between opposite ends of the handle and each providing a throat of dimensions approximating the cross-section of the associated strap, said means attached to said free end of each said strap being of greater dimensions than the dimensions of said throat; and mutually cooperation pairs of separable and connectible fastener members, are fastener member of each said pair attached respectively to said free end of each said strap and the other said fastener member of each said pair being rigidly affixed one to each said side wall of said frame at a distance along said peripheral frame from the nearest bail approximating the length of the associated strap between its attachment to said handle and said means at the free end of said strap;

whereby, when said fastener members are engaged and said case is lifted by said handle, said straps are held tensioned against the top and side walls of said peripheral frame and hold said handle in a position closely adjacent said top wall and centrally thereof with said bails abutting the respective opposite ends of the handle, and, when said fastener memebers are separated from each other, said straps can be drawn axially through said bails to engage said means with said bails and provide a shoulder strap for carrying said case.

2. The attache case according to claim 1, in which said fastener members are press studs.

3. The attache case of claim 1, in which said bails are metal channels having legs attached to said top wall of said peripheral frame.

* * * * *